US009724616B1

(12) United States Patent
Pedersen

(10) Patent No.: US 9,724,616 B1
(45) Date of Patent: Aug. 8, 2017

(54) AUTOMATIC INFLATABLE TOY WITH HOUSING

(71) Applicant: Tech 4 Kids Inc., Mississauga (CA)

(72) Inventor: Bradley D. Pedersen, Mississauga (CA)

(73) Assignee: Tech 4 Kids, Inc., Mississauga, ON (CA)

( * ) Notice: Subject to any disclaimer, the term of this patent is extended or adjusted under 35 U.S.C. 154(b) by 0 days.

(21) Appl. No.: 15/275,562

(22) Filed: Sep. 26, 2016

(51) Int. Cl.
*A63H 3/06* (2006.01)
*A63H 27/10* (2006.01)

(52) U.S. Cl.
CPC ..... *A63H 27/10* (2013.01); *A63H 2027/1033* (2013.01); *A63H 2027/1041* (2013.01); *A63H 2027/1075* (2013.01)

(58) Field of Classification Search
CPC .... A63H 2027/1033; A63H 2027/1041; A63H 2027/1075; A63H 27/10
USPC ..... 446/220, 226
See application file for complete search history.

(56) References Cited

U.S. PATENT DOCUMENTS 3,091,053 A * 5/1963 Growald ..... A63H 3/00 264/46.4
4,020,786 A * 5/1977 Kopeika ..... B64B 1/52 116/210
4,758,198 A * 7/1988 Ishiwa ..... A63H 3/06 137/512
4,781,645 A * 11/1988 Kato ..... A63H 33/00 441/100
4,846,278 A * 7/1989 Robbins ..... B01J 7/02 102/333
4,898,561 A 2/1990 Nottingham et al.
5,480,339 A * 1/1996 Wu ..... A63H 3/06 446/220
5,492,500 A * 2/1996 Sinclair ..... B29D 22/02 244/31
5,941,752 A * 8/1999 Liebermann ..... A63H 27/10 441/31
2007/0037472 A1* 2/2007 Greenwald ..... A63H 27/10 446/220

* cited by examiner

*Primary Examiner* — Vishu Mendiratta
(74) *Attorney, Agent, or Firm* — Adam K. Sacharoff; Much Shelist, P.C.

(57) ABSTRACT

A self-inflatable toy having first and second housing portions and an inflatable toy body positioned there-between. The inflatable toy body having chemicals that react to produce an inflating gas. The first and second housing having beads that interact to temporarily prevent the separation of the two housings. As the toy body inflates, a pressure increases between the two housings until the increasing pressure is greater than the friction between the first and second beads causing the first housing to separate from the second housing.

6 Claims, 7 Drawing Sheets

AUTOMATIC INFLATABLE TOY WITH HOUSING

FIELD OF THE INVENTION

The present disclosure relates to an automatic or self-inflating toy placed in a housing, which pops apart during the inflating process to reveal the inflatable toy.

BACKGROUND OF THE INVENTION

Automatic inflating toys and balloons are well known in the art. U.S. Pat. No. 4,898,561 appears to be one of the first toys that utilized chemicals that are kept separate by a membrane inside the toy. Rupturing the membrane caused the chemicals to mix and react to produce a gas inflating the toy. However, this is as far as the prior art provides. There is thus a need to increase the enjoyment of these toys and to provide a safe transport mechanism to ensure the toys do not self-inflate prior to the desired time. The present invention solves this problem by providing an automatic or self-inflating toy placed in a housing, which acts as a protective capsule in transit as well as in retail shelves and which pops apart during the inflating process to reveal the inflatable toy.

SUMMARY OF THE INVENTION

In one embodiment there is provided a self-inflatable toy. The toy includes a housing having a, second and third housing portions. The first housing portion has a first base and a first sidewall extending from the first base to create a first internal space there-between. The first housing portion further includes at least one first bead facing internally to the first internal space and positioned along a portion of the first sidewall and configured around a portion of the periphery of the first sidewall. The second housing portion has a second base and a second sidewall extending from the second base. The second housing portion being situated partially within the first internal space, such that the second base is positioned adjacent the first base. The second housing portion further includes at least one second bead facing externally to the second sidewall and positioned along a portion of the second sidewall. The at least first and second beads are configured to interact with each other to prevent separation of the first and second housings until a force is exerted between first and second housings that is greater than a frictional force exhibited between the first and second beads. The toy further includes a toy body positioned between the first base and second base within the first internal space. The toy body having contained therein a capsule. A first chemical is placed within the toy body and a second chemical is placed within the capsule, and the first and the second chemicals are configured to create an inflating gas when mixed. The toy body is configured to inflate when the capsule is ruptured and the first and second chemicals mix to react forming the inflating gas. Thus, when the capsule within the toy body ruptures, caused by the first and second bases being pushed together, the first and second chemicals within the toy body mix and react to form the inflating gas. This causes the toy body to inflate and further causes the first base and the second base to move away from each other until the at least one first and second beads interact, and whereby an increasing pressure is created between the first and second housings as the toy body continues to inflate until the increasing pressure is greater than the frictional between the first and second beads causing the first housing to separate from the second housing to reveal the inflatable toy body.

In another aspect of the present invention, the housing further has a third housing portion. The third housing portion has a third base and a third sidewall extending from the third base to create a third internal space there-between. The third housing portion sized such that a section of the second housing portion fits within the third internal space, and the third housing portion configured wherein a first terminal edge of the first sidewall abuts a third terminal edge of the third sidewall when the third housing portion is positioned over the second housing portion.

In other aspects of the invention, the length of the second sidewall is longer than the third sidewall such that the second base is positioned within the first internal space. The first and second chemicals may also be citric acid and sodium bicarbonate. In addition, the third base may include an opening to receive a projection knob, the projection knob configured to assist in displaying the toy body on the third base. Furthermore, a coating may be applied on a portion of an outside surface of the toy body, and wherein the coating is a talcum powder used to prevent the toy body from adhering to the first housing or the second housing.

In another embodiment of the present invention there is provided a self-inflatable toy defined to have first and second housing portions and an inflatable toy body positioned there-between. The inflatable toy body having at least two chemicals that react to produce an inflating gas. The first and second housing having beads configured to interact with each other to temporarily prevent the separation of the two housings. As the toy body inflates, a pressure increases between the two housings until the increasing pressure is greater than a friction defined between the first and second beads which causes the first housing to separate from the second housing to reveal the inflatable toy body.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION OF THE INVENTION

The present disclosure describes a self-inflating toy enclosed in a housing for transport purposes and which housing pops apart during the inflating process to reveal the toy inside. The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

Figure 1:
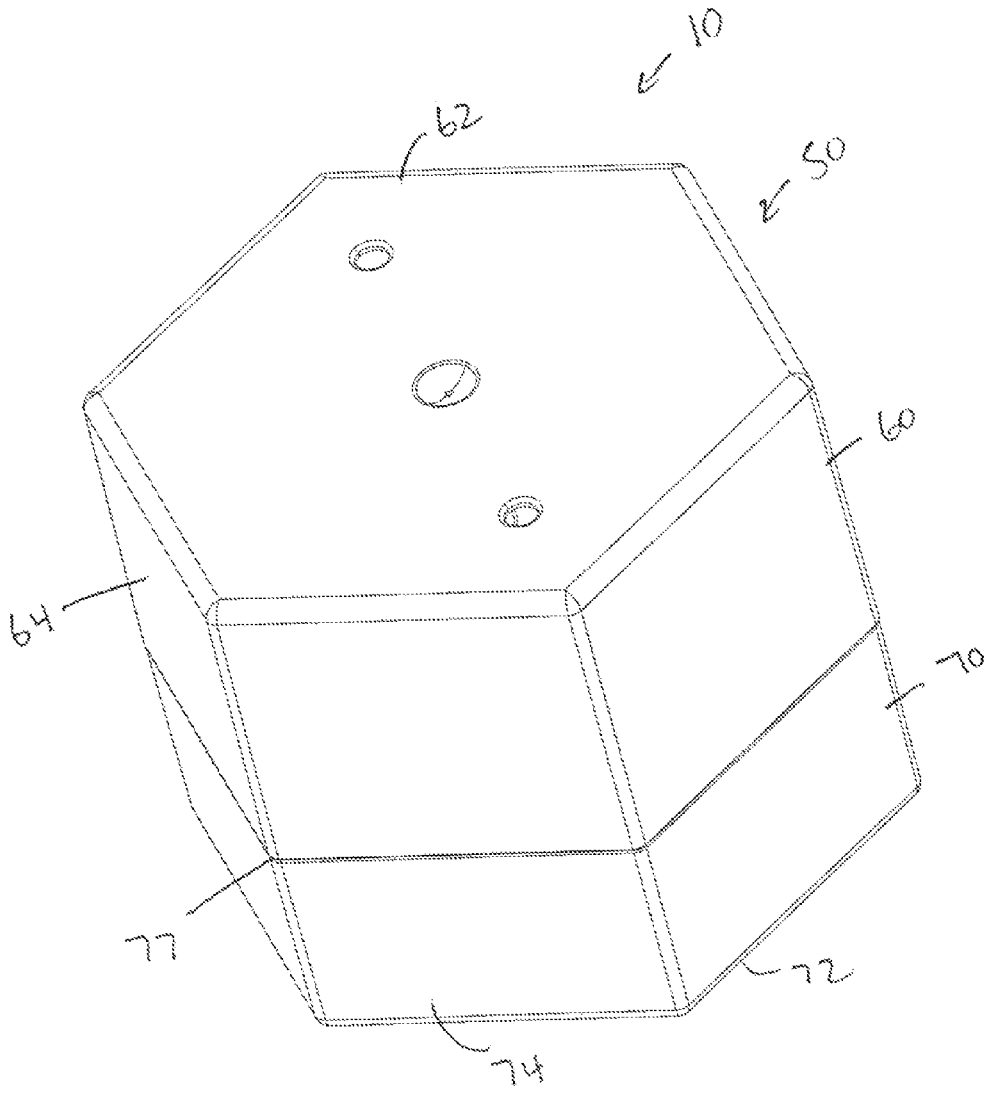
FIG. 1 is a first perspective view of one embodiment of the present invention illustrating the housing that enclosing the self-inflatable toy.
Figure 2:
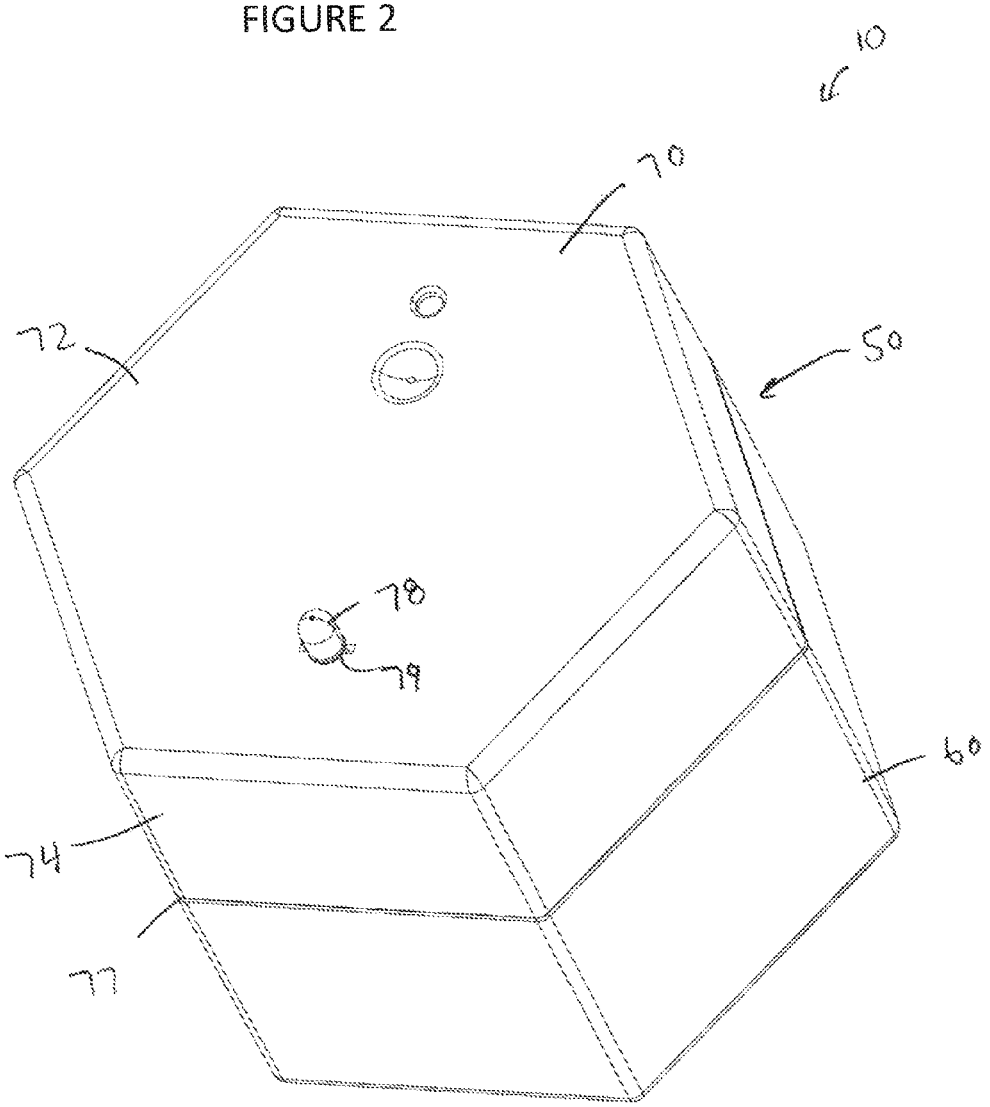
FIG. 2 is a third perspective view of one embodiment of the present invention illustrating the housing that enclosing the self-inflatable toy.
Figure 3:
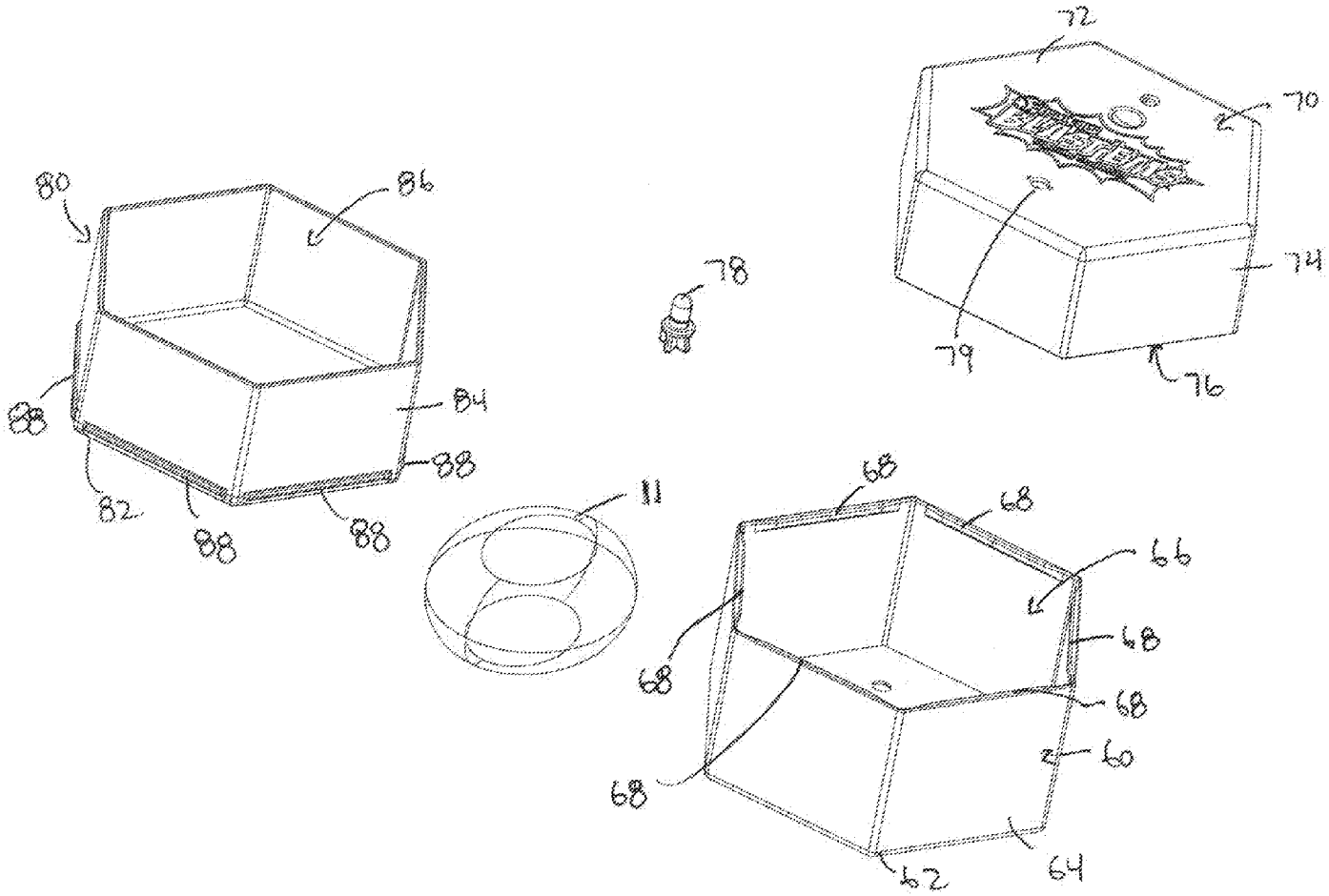
FIG. 3 is an exploded view of one embodiment of the present invention.
Figure 4:
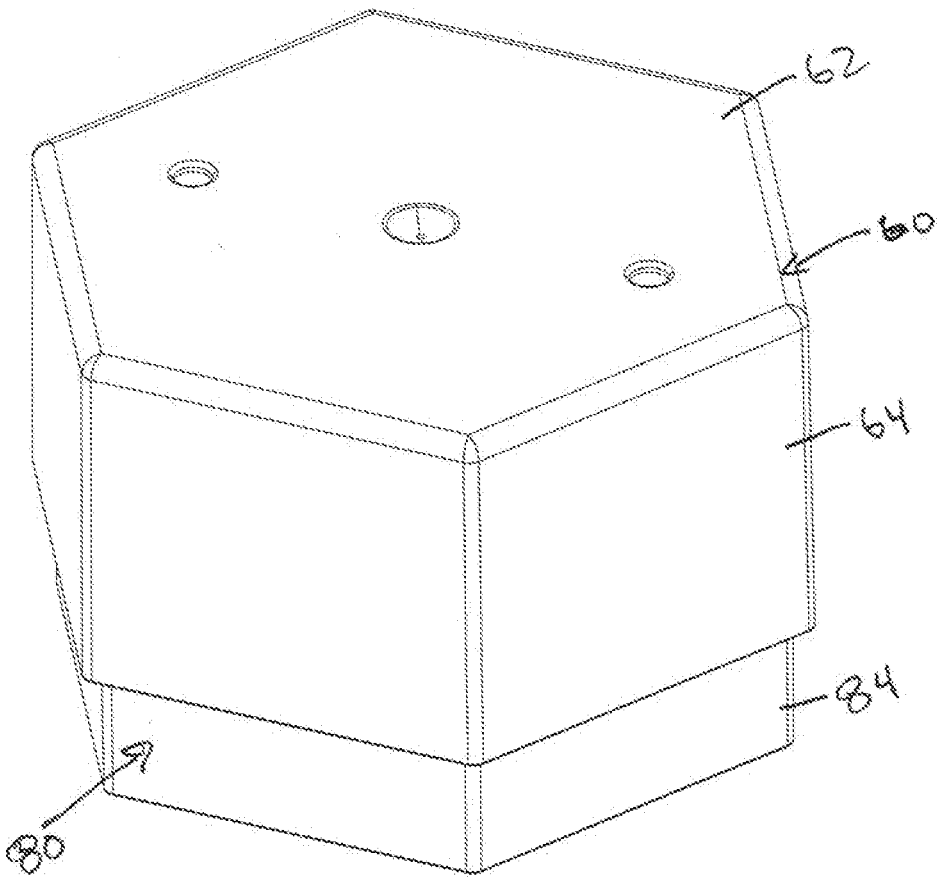
FIG. 4 is a first perspective view of one embodiment of the present invention illustrating the housing that enclosing the self-inflatable toy without the third housing.
Figure 5:
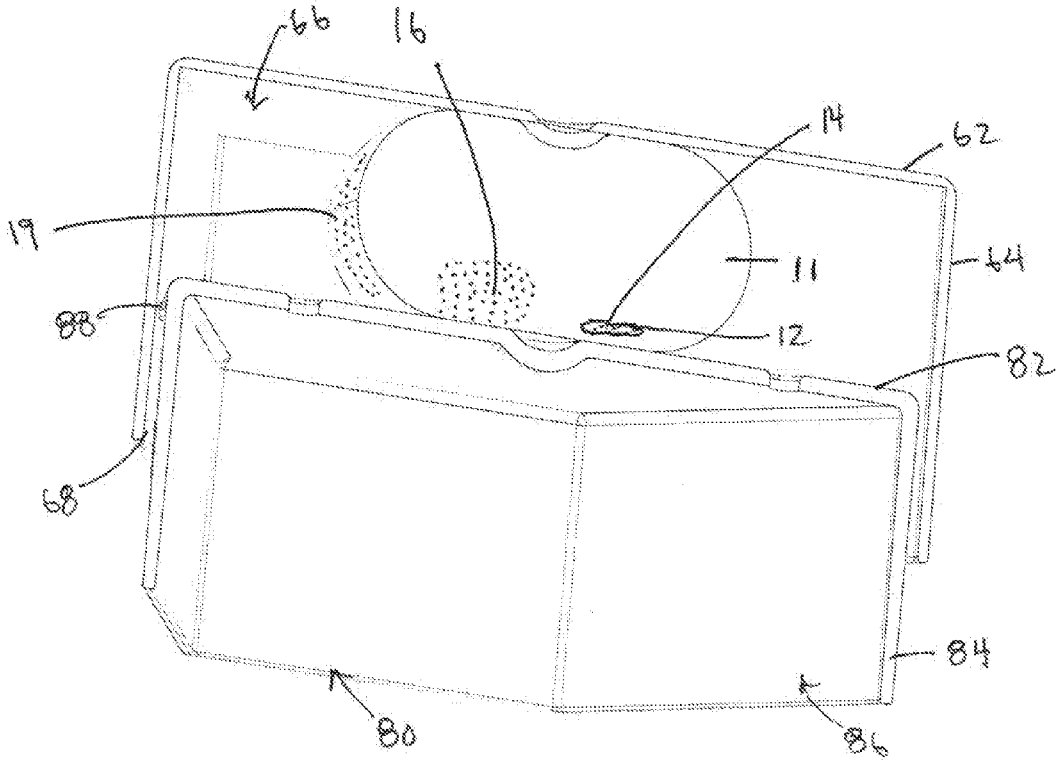
FIG. 5 is a cross-section view of one embodiment of the present invention.
Figure 6:
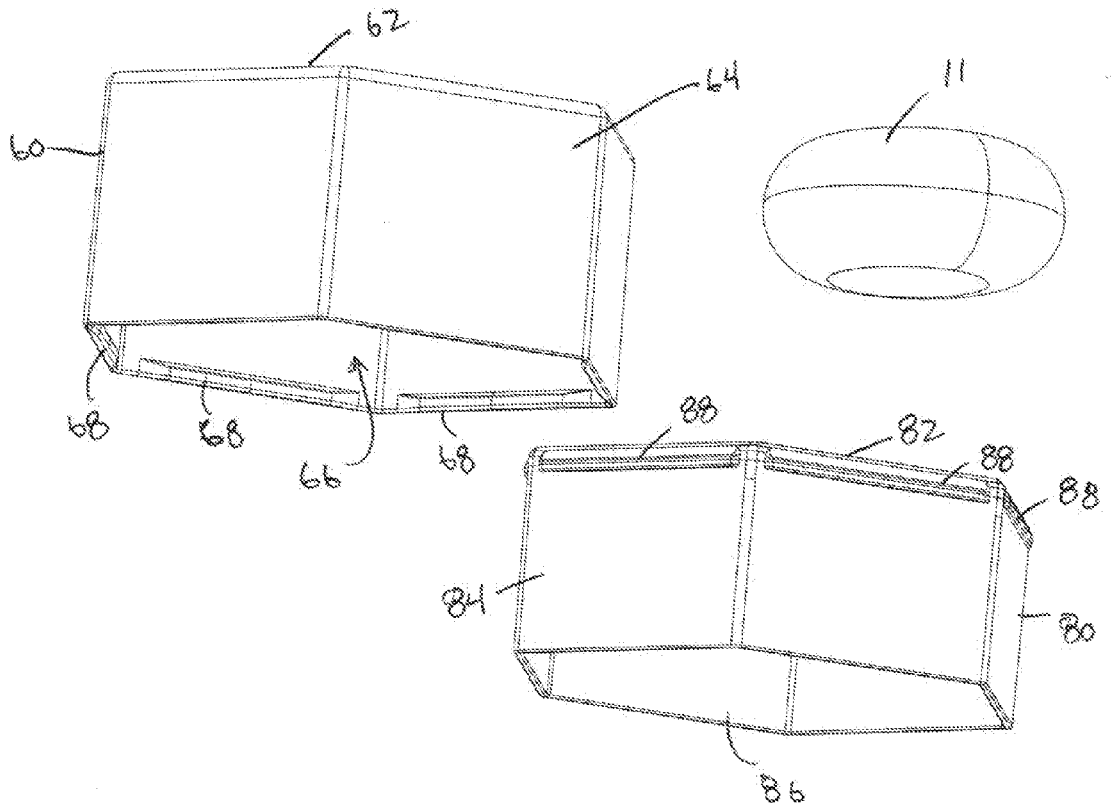
FIG. 6 is an exploded view of one embodiment of the present invention without the third housing.
Figure 7:
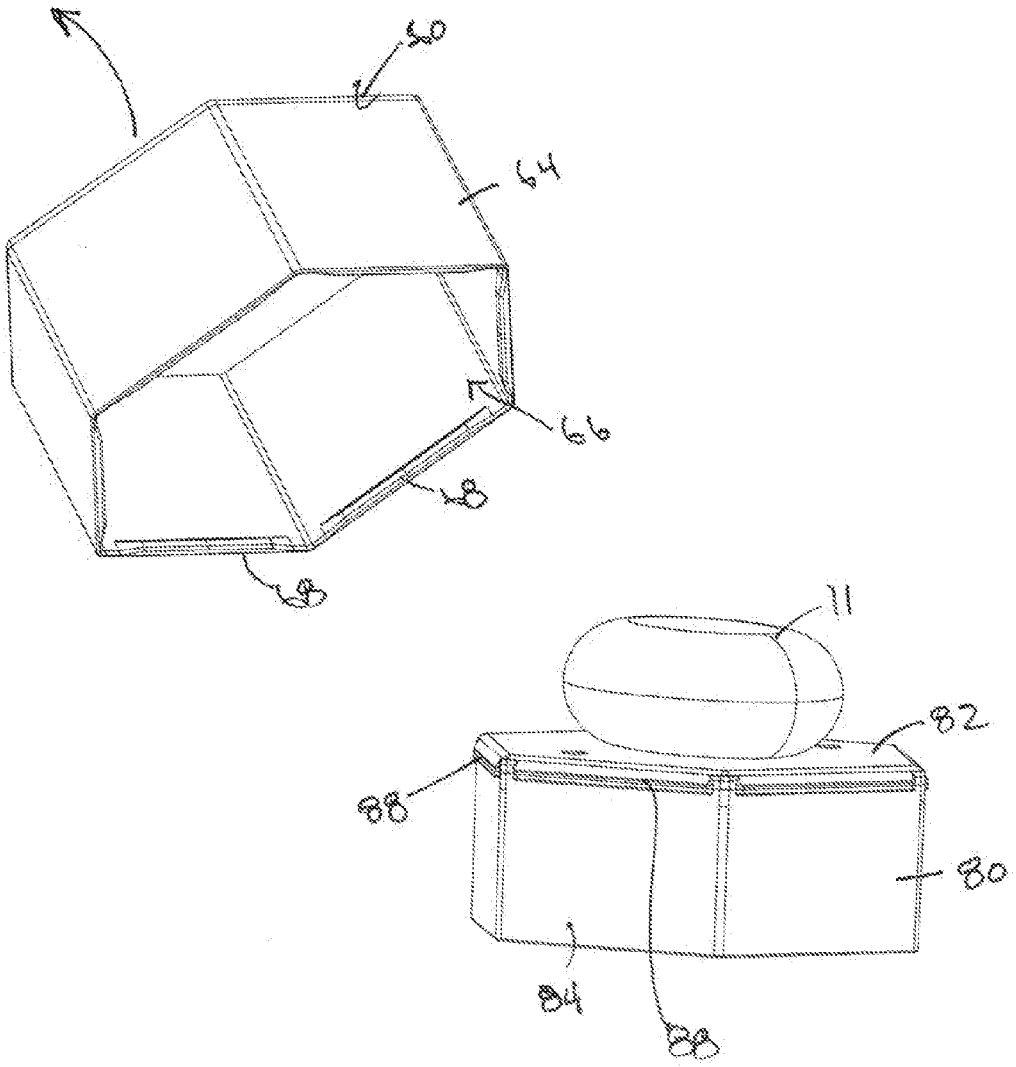
FIG. 7 is a perspective view showing the popping of the first housing away from the second housing and the self-inflating toy.

Referring now to FIGS. 1-7, there is provided a self-inflating toy 10 that is positioned within a housing apparatus 50. The housing apparatus 50 is constructed such that during the inflating process the housing apparatus 50 will come apart to reveal the toy placed therein.

The self-inflating toy 10 uses citric acid and sodium bicarbonate chemicals kept separate from each other during packaging to ensure the toy remaining substantially flat. One of the chemicals 16 is provided within the toy body 11 and the other chemical 14 is placed inside a breakable capsule 12 also inside the toy body 11. Once the capsule is broken the chemicals mix and react to create a gas, such as carbon dioxide, which inflates the toy body 11. Other chemicals can be used, for example different acids and bases may be used, which when mixed, react to produce an inflating gas. The toy body 11 may be made from a flexible material such that it expands during the inflation process, or it may be made from a Mylar or other type of material that simply inflates or expands during the process.

The housing 50 is illustrated as a three part housing: a first housing portion 60, a third housing portion 70 and a second housing portion 80. The first housing portion 60 and the third housing portion 70 fit together encasing the second housing portion 80 and the toy 10 within during transport and shipping. As such the first housing portion 60 includes a first base 62 and a first sidewall 64 extending from the first base 62 to create a first internal space 66 there-between. Similarly, the third housing portion 70 includes a third base 72 and a third sidewall 74 extending from the third base 72 to create a third internal space 76 there-between. The first and third sidewalls 74 are configured to meet creating a seam 77 between the first and third housing portions.

As noted the second housing portion 80 positioned or captured within the internal spaces 66 and 76 is defined to include a second base 82 with a second sidewall 84 extending from the second base 82. The length of the second sidewall 84 is defined to be longer than the third sidewall 74 such that the second base 82 rests within the first internal space 66. The second sidewall 84 also includes one or more externally facing second beads or flanges 88 along a portion of the second sidewall 84 and defined to be configured around a portion of the periphery of the second sidewall 84 that rests within the first internal space 66. In addition, the first sidewall 64 includes one or more internally facing first beads or flanges 68 along a portion of the first sidewall 64 and defined to be configured around a portion of the periphery of the first sidewall 64 that rests below the second beads or flanges 88 such that the beads 68/88 are configured to work in concert with each other (explained in further detail below).

In use, the user will remove the third housing 70 and place the assembly on a surface with the first base 62 facing upwards, resting the second sidewall 84 on the surface. The toy body 11 is positioned between the first base 62 and the second base 82. The user the smashes or presses the first base 62 and the second base 82 together breaking the capsule 12 that is inside the toy body 11, causing the chemicals to mix and react to form the inflating gas. As the toy body 11 inflates, the first housing 60 will raise away from the second housing 80 until the beads 68/88 come into contact sfirstping the movement of the first housing 60. This causes a buildup of pressure under the first housing 60 as the toy body 11 continues to inflate. Eventually the pressure forces the first beads 68 to move past the second beads 88 at a force that cause the first housing 60 to pop off or away from the second housing. As this occurs the inflating toy is revealed.

The user may then play with the toy body 11. To help display the inflated toy body 11, the user may place the toy body 11 on first of the third base 72 of the third housing 70. Since the inflated toy body 11 may be round, oval, or other shape, to help maintain and keep the toy body 11 steady on first of the third base 72, the third base 72 may include a projection knob 78, that projects through an opening 79 on the third base 72.

In another aspect of the invention, the outside surface of the toy can coated with a talcum powder or other substance 19. By adding the powder or substance to the outside of the toy body 11, it has been found that it acts as a lubricant that prevents the toy from sticking or adhering to the housing. This also provides a further enjoyment as the housing pops open the toy can further spring to life.

In the prior art the self-inflating toy would normally be shipped and sold flat and the child would place the toy on a flat surface and using their hand would smash the toy breaking the capsule. Problems occurred in the prior art in that capsule would prematurely break during transport or in the store, defeating the purpose and spirit of the enjoyment with the toy. One or more embodiments of the present invention solves this problem.

This application includes description that is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. It is understood that the specific order or hierarchy of steps or blocks in the processes disclosed is an illustration of exemplary approaches. Based upon design preferences, it is understood that the specific order or hierarchy of steps or blocks in the processes may be rearranged. The accompanying method claims present elements of the various steps in a sample order, and are not meant to be limited to the specific order or hierarchy presented. Thus, the claims are not intended to be limited to the aspects shown herein, but is to be accorded the full scope consistent with the language claims.

Headings and subheadings, if any, are used for convenience only and do not limit the invention. Reference to an element in the singular is not intended to mean "one and only one" unless specifically so stated, but rather "one or more." Use of the articles "a" and "an" is to be interpreted as equivalent to the phrase "at least one." Unless specifically stated otherwise, the terms "a set" and "some" refer to one or more. Terms such as "first," "third," "upper," "lower," "left," "right," "front," "rear" and the like as used in this disclosure should be understood as referring to an arbitrary frame of reference, rather than to the ordinary gravitational frame of reference. Thus, a first surface, a third surface, a front surface, and a rear surface may extend upwardly, downwardly, diagonally, or horizontally in a gravitational frame of reference.

Although the relationships among various components are described herein and/or are illustrated as being orthogonal or perpendicular, those components can be arranged in other configurations in some embodiments. For example, the angles formed between the referenced components can be greater or less than 90 degrees in some embodiments. Although various components are illustrated as being flat and/or straight, those components can have other configurations, such as curved or tapered for example, in some embodiments.

Pronouns in the masculine (e.g., his) include the feminine and neuter gender (e.g., her and its) and vice versa. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "operation for."

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such as an embodiment may refer to one or more embodiments and vice versa.

The word "exemplary" if used herein means "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. Furthermore, to the extent that the term "include," "have," or the like is used in the description or the claims, such term is intended to be inclusive in a manner similar to the term "comprise" as "comprise" is interpreted when employed as a transitional word in a claim.

Although embodiments of the present disclosure have been described and illustrated in detail, it is to be clearly understood that the same is by way of illustration and example only and is not to be taken by way of limitation, the scope of the present invention being limited only by the terms of the appended claims.

I claim:

1. A self-inflatable toy system comprising:

first and second housings, the first housing being defined to have a first base and a first sidewall extending downwardly from a periphery of the first base to create a first internal space there-between, at least one first bead facing internally into the first internal space and positioned along a bottom portion of the first sidewall that is distal to the first base, and wherein the second housing being defined to have a second base and a second sidewall extending downwardly from a periphery of the second base, at least one second bead facing externally away from the second sidewall and positioned along a top portion of the second sidewall that is proximal to the second base, and a combined configuration defined by the first housing positioned over and the second housing such that the first and second bases face each other defining a headspace there between, and the first sidewall extends externally to the second sidewall aligning the first and second beads, wherein when the first and second housings are moved in relation to each other, the first and second beads come into contact and define a stopping friction to restrain the first and second housings in the combined configuration, a separable configuration defined by exerting a force between the first and second housings greater than the stopping friction such that the first and second housings separate from each other;

an inflatable toy body having a deflated configuration and an expanded configuration, the inflatable toy body having a first chemical contained therein, and further having a breakable capsule, the breakable capsule having a second chemical, wherein the first and the second chemicals are configured to create an inflating gas when mixed, and wherein the inflatable toy body being positioned in the headspace when in a deflated configuration and when the first and second housings are in the combined configuration, and wherein when the first base and second base are pressed together with a force sufficient to rupture the breakable capsule the first and second chemicals mix creating the inflating gas within the inflatable toy body to cause the inflatable toy body to expand from the deflated configuration to the expanded configuration, the expanded configuration further configured to cause the first and second housings to separate from each other from the combined configuration to the separable configuration to reveal the inflatable toy body.

2. The self-inflatable toy system of claim 1 further comprising a third housing, the third housing having a third base and a third sidewall extend from the third base to create a third internal space there-between, the third housing sized such that a section of the second housing portion fits within the third internal space, and the third housing configured wherein a first terminal edge of the first sidewall abuts a third terminal edge of the third sidewall when the third housing is positioned over the second housing portion.

3. The self-inflatable toy system of claim 2, wherein the length of the second sidewall is longer than the third sidewall such that the second base is positioned within the first internal space.

4. The self-inflatable toy system of claim 2, wherein the third base includes an opening to receive a projection knob, the projection knob configured to assist in displaying the toy body on the third base.

5. The self-inflatable toy system of claim 1, wherein the first chemical and second chemical are citric acid and sodium bicarbonate.

6. The self-inflatable toy system of claim 1 further comprising a coating on a portion of an outside surface of the toy body, and wherein the coating is a talcum powder used to prevent the toy body from adhering to the first housing or the second housing.

* * * * *